US011819115B1

(12) United States Patent
Pittmon

(10) Patent No.: US 11,819,115 B1
(45) Date of Patent: Nov. 21, 2023

(54) ROTATING BRUSH STAND

(71) Applicant: Nosha Pittmon, Spartanburg, SC (US)

(72) Inventor: Nosha Pittmon, Spartanburg, SC (US)

( * ) Notice: Subject to any disclaimer, the term of this patent is extended or adjusted under 35 U.S.C. 154(b) by 326 days.

(21) Appl. No.: 17/307,022

(22) Filed: May 4, 2021

(51) Int. Cl.
*A46B 17/06* (2006.01)
*A46B 17/02* (2006.01)

(52) U.S. Cl.
CPC ..... *A46B 17/06* (2013.01); *A46B 17/02* (2013.01)

(58) Field of Classification Search
CPC ..... A46B 17/06; A46B 17/02; A46B 17/065; B08B 11/02
See application file for complete search history.

(56) References Cited

U.S. PATENT DOCUMENTS

| | | | | |
|---|---|---|---|---|
| 2,145,456 | A | 1/1939 | Oshman | |
| 3,720,703 | A | 3/1973 | Elliott | |
| 9,210,996 | B1 | 12/2015 | Kramer | |
| 9,380,860 | B1 | 7/2016 | Taylor | |
| 9,848,723 | B1 | 12/2017 | Huang | |
| D854,250 | S | 7/2019 | Huang | |
| 2017/0119145 | A1* | 5/2017 | Munoz | F26B 25/22 |
| 2018/0264875 | A1 | 9/2018 | Mongan | |

* cited by examiner

*Primary Examiner* — Shay Karls
(74) *Attorney, Agent, or Firm* — Kyle A. Fletcher, Esq.

(57) ABSTRACT

The rotating brush stand comprises a shell, a brush holder, a drive circuit, and a plurality of brushes. The brush holder stores the plurality of brushes. The shell contains the brush holder, the drive circuit, and the plurality of brushes. The rotating brush stand stores the plurality of brushes in anticipation of use. The rotating brush stand immerses the plurality of brushes in a cleaning solution. The rotating brush stand is a rotating structure. The drive circuit rotates the plurality of brushes within the cleaning solution to clean the plurality of brushes.

16 Claims, 8 Drawing Sheets

ROTATING BRUSH STAND

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of brushware and brushes including apparatus for holding brushes.

SUMMARY OF INVENTION

The rotating brush stand comprises a shell, a brush holder, a drive circuit, and a plurality of brushes. The brush holder stores the plurality of brushes. The shell contains the brush holder, the drive circuit, and the plurality of brushes. The rotating brush stand stores the plurality of brushes in anticipation of use. The rotating brush stand immerses the plurality of brushes in a cleaning solution. The rotating brush stand is a rotating structure. The drive circuit rotates the plurality of brushes within the cleaning solution to clean the plurality of brushes.

These together with additional objects, features and advantages of the rotating brush stand will be readily apparent to those of ordinary skill in the art upon reading the following detailed description of the presently preferred, but nonetheless illustrative, embodiments when taken in conjunction with the accompanying drawings.

In this respect, before explaining the current embodiments of the rotating brush stand in detail, it is to be understood that the rotating brush stand is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the rotating brush stand.

It is therefore important that the claims be regarded as including such equivalent construction insofar as they do not depart from the spirit and scope of the rotating brush stand. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
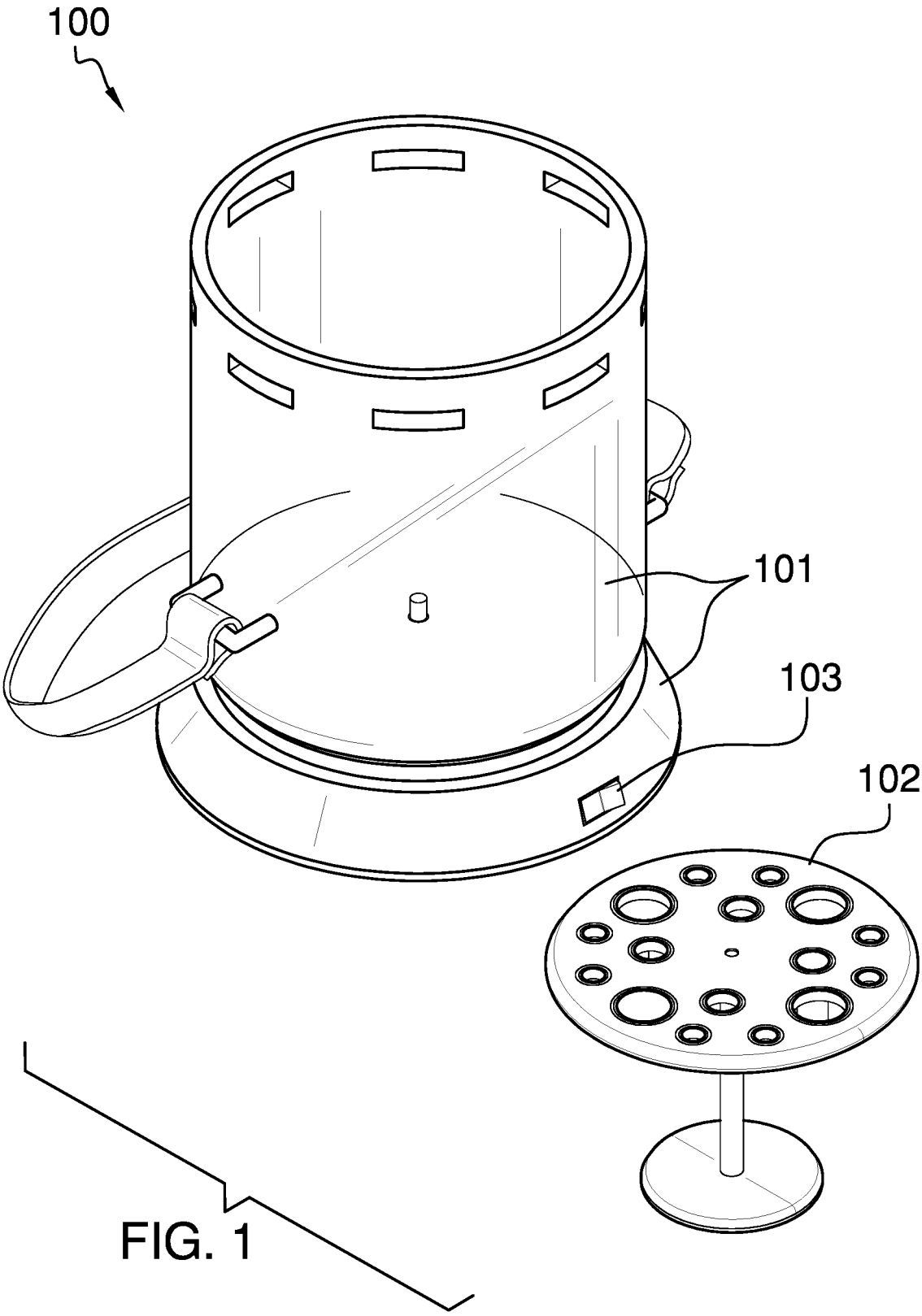
FIG. 1 is a perspective view of an embodiment of the disclosure.
Figure 2:
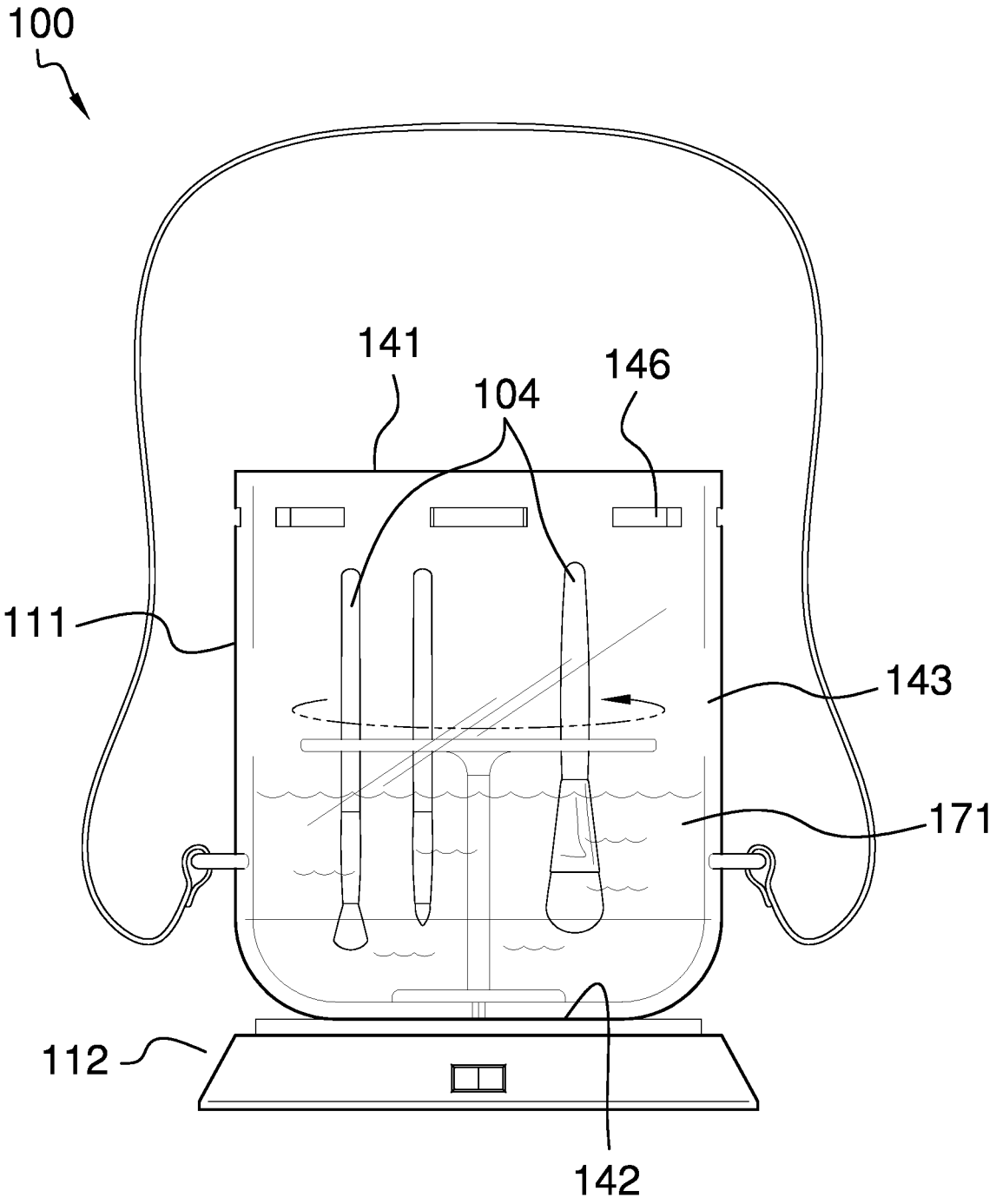
FIG. 2 is an in-use view of an embodiment of the disclosure.
Figure 3:
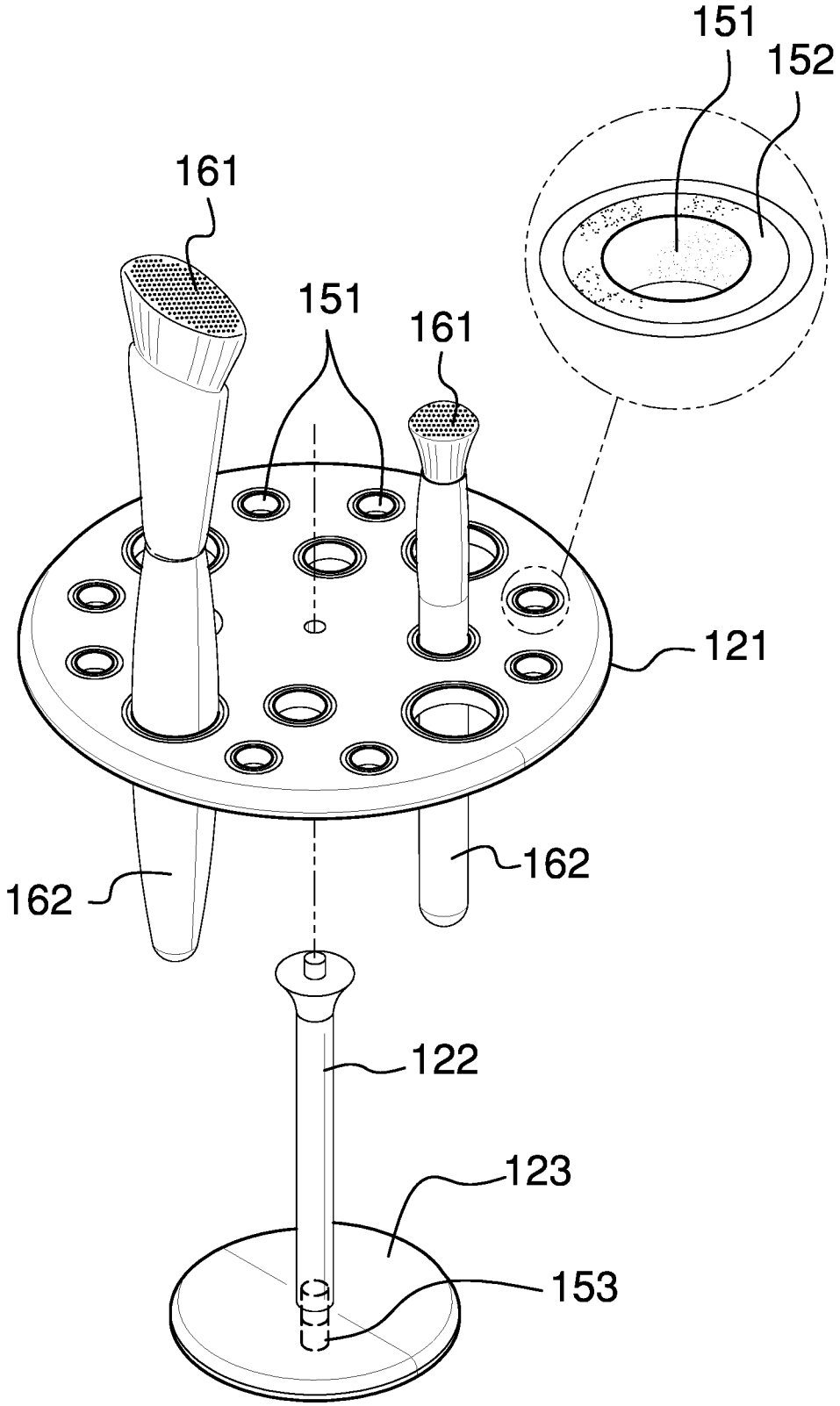
FIG. 3 is a detail view of an embodiment of the disclosure.
Figure 4:
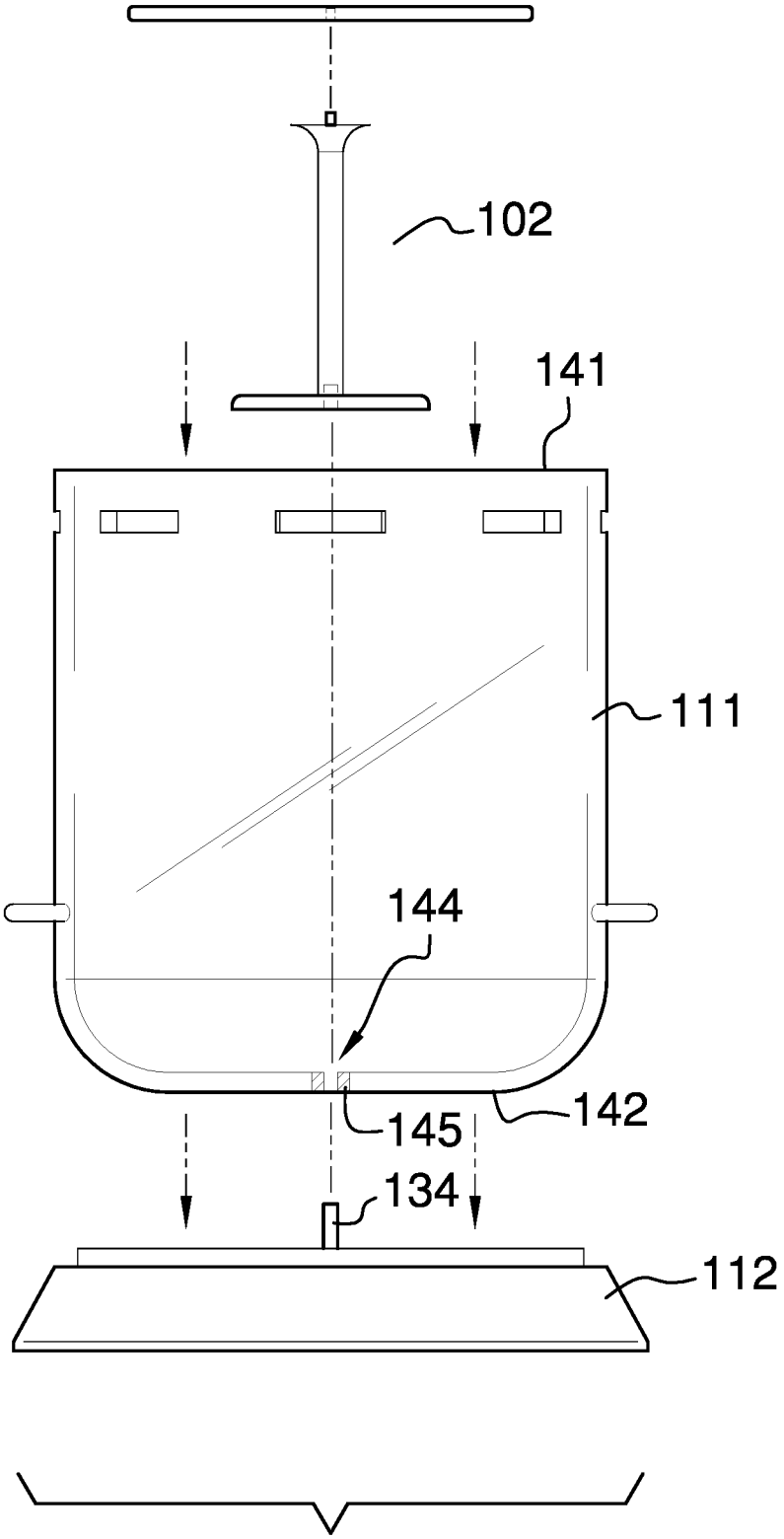
FIG. 4 is an exploded view of an embodiment of the disclosure.
Figure 5:
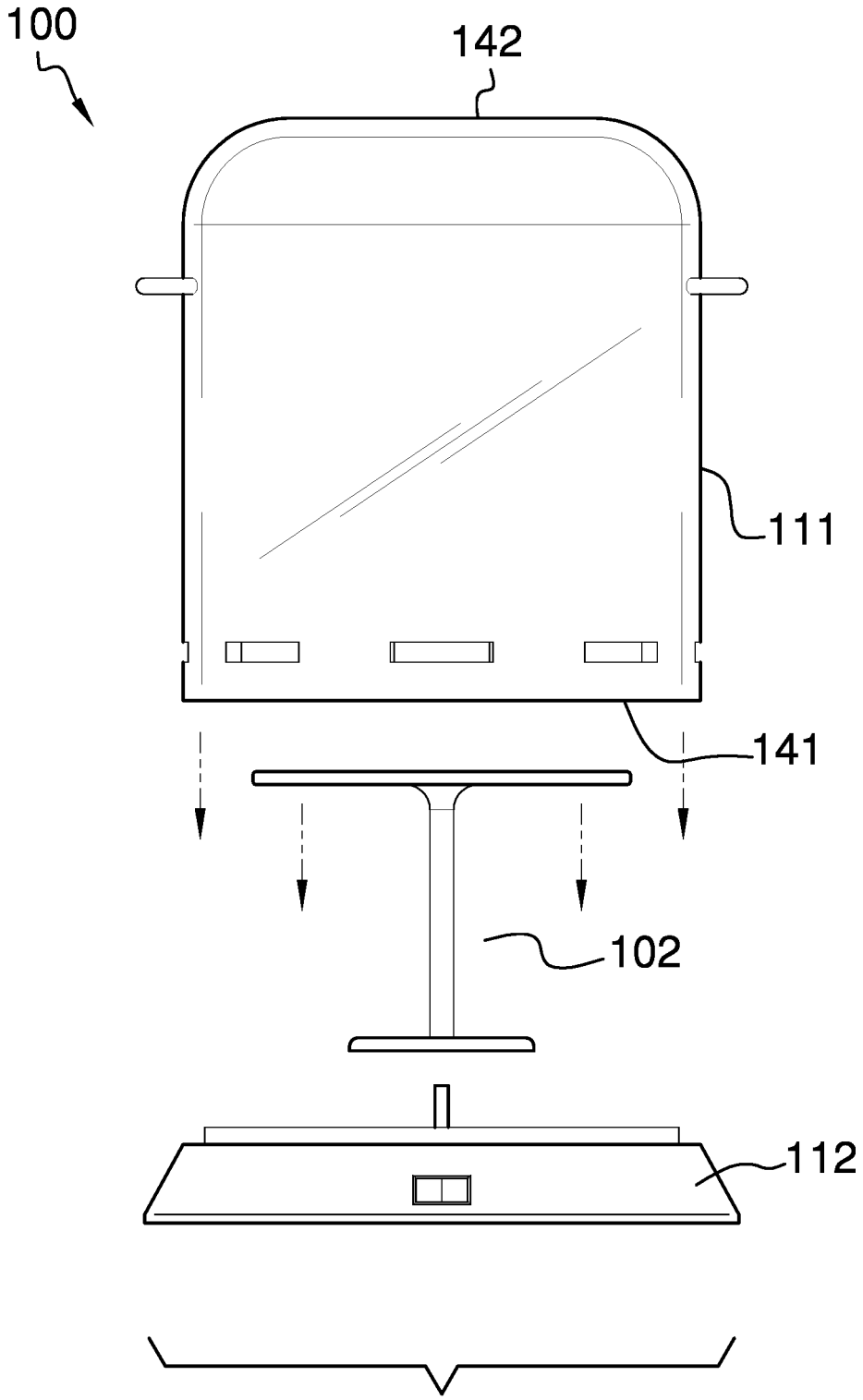
FIG. 5 is an exploded view of an embodiment of the disclosure.
Figure 6:
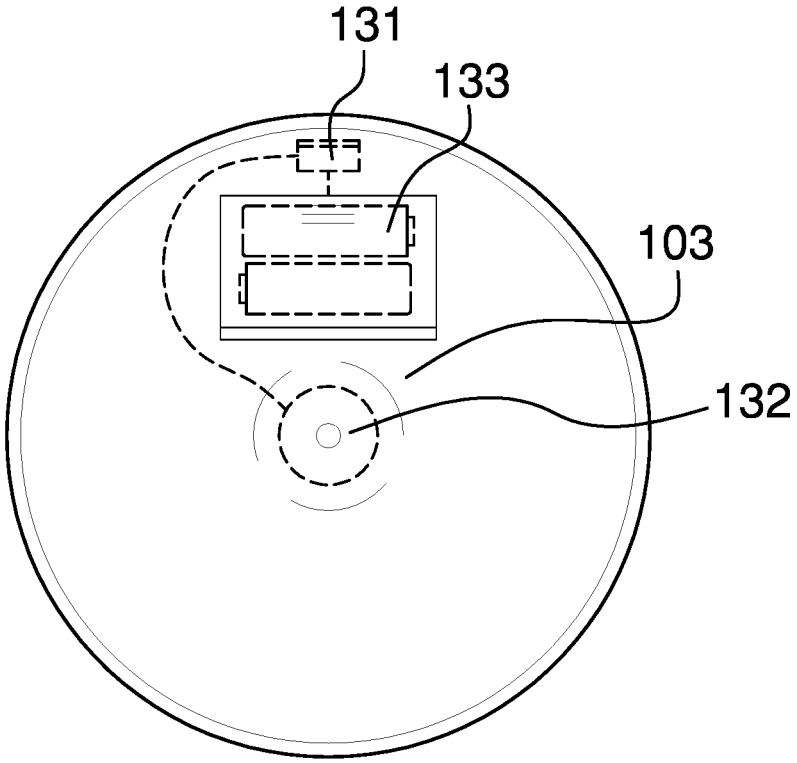
FIG. 6 is a top view of an embodiment of the disclosure.
Figure 7:
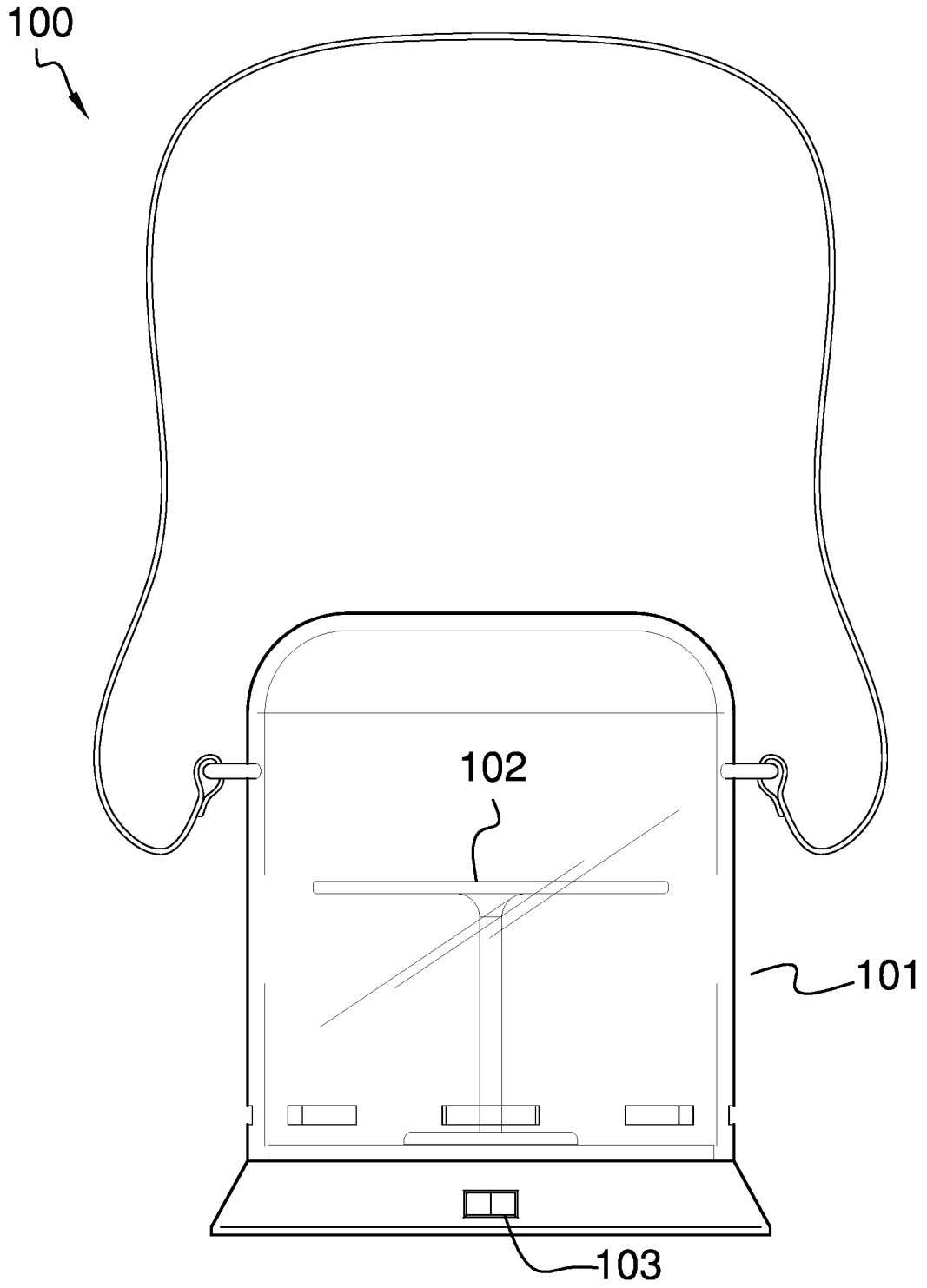
FIG. 7 is a front view of an embodiment of the disclosure.
Figure 8:
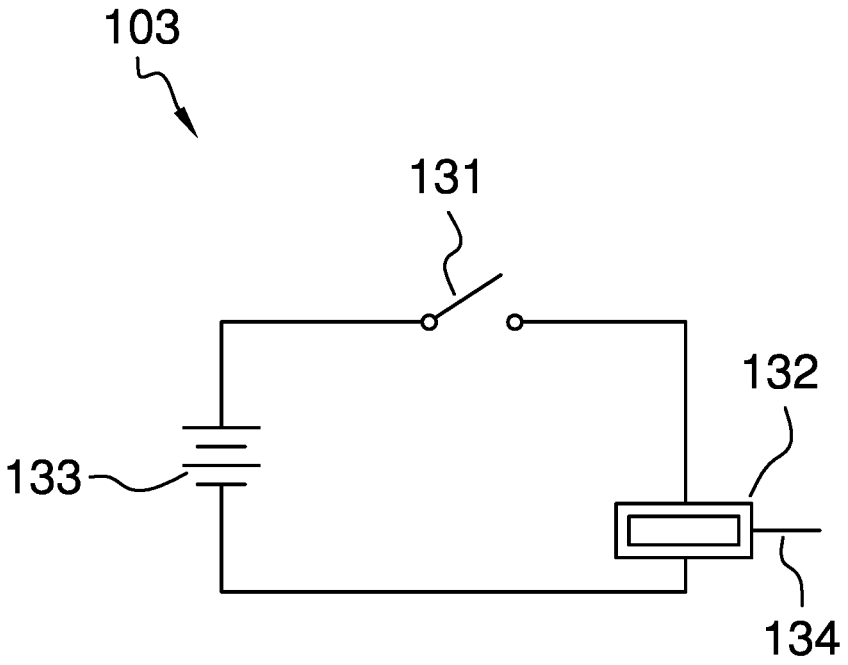
FIG. 8 is a schematic view of an embodiment of the disclosure.

Detailed reference will now be made to one or more potential embodiments of the disclosure, which are illustrated in FIGS. 1 through 8.

The rotating brush stand 100 (hereinafter invention) comprises a shell 101, a brush holder 102, a drive circuit 103, and a plurality of brushes 104. The brush holder 102 stores the plurality of brushes 104. The shell 101 contains the brush holder 102, the drive circuit 103, and the plurality of brushes 104. The invention 100 stores the plurality of brushes 104 in anticipation of use. The invention 100 immerses the plurality of brushes 104 in a cleaning solution 171. The invention 100 is a rotating structure. The drive circuit 103 rotates the plurality of brushes 104 within the cleaning solution 171 to clean the plurality of brushes 104. The cleaning solution is defined elsewhere in this disclosure.

Each of the plurality of brushes 104 is a tool. The brush is defined elsewhere in this disclosure. Each individual brush selected from the plurality of brushes 104 further comprises an individual brush head 161 and an individual brush handle 162. The individual brush head 161 is the working element of the tool formed by any brush selected from the plurality of brushes 104. The individual brush handle 162 is the handle of the tool formed by any brush selected from the plurality of brushes 104.

The shell 101 is a prism-shaped structure. The shell 101 has a composite prism-shape. The shell 101 forms a housing that contains the brush holder 102, the drive circuit 103, the plurality of brushes 104, and the cleaning solution 171. The shell 101 is a rigid structure. The shell 101 is formed with all the apertures to allow for the operation of the brush holder 102 and the drive circuit 103. The shell 101 forms a fluid impermeable configuration that contains the cleaning solution 171. The shell 101 comprises a shell 101 pan 111 and a shell 101 pedestal 112.

The shell 101 pan 111 is a prism-shaped structure. The shell 101 pan 111 is a hollow structure. The shell 101 pan 111 has a pan shape. The shell 101 pan 111 forms a fluid impermeable structure. The shell 101 pan 111 mounts on the shell 101 pedestal 112 to form a composite prism structure. The shell 101 pan 111 comprises an open face 141, a closed face 142, and a lateral face 143.

The open face 141 is the open face 141 of the pan structure of the shell 101 pan 111. The open face 141 is distal from the shell 101 pedestal 112 when the invention 100 is configured for use in cleaning. The open face 141 is proximal to the shell 101 pedestal 112 when the shell 101 pan 111 encloses the plurality of brushes 104. The shell 101 pan 111 is an invertible structure. When the open face 141 of the shell 101 pan 111 forms the superior structure of the shell 101 pan 111, the shell 101 pan 111 contains the brush holder 102, the plurality of brushes 104, and the cleaning solution 171. When the open face 141 of the shell 101 pan 111 forms the inferior structure of the shell 101 pan 111, the shell 101 pan 111 encloses the brush holder 102 and the plurality of brushes 104.

The closed face 142 is the closed face 142 of the pan structure of the shell 101 pan 111. The closed face 142 is the face of the shell 101 pan 111 that is distal from the open face 141. The closed face 142 further comprises a drive shaft 134 aperture 144 and a drive shaft 134 gasket 145.

The drive shaft 134 aperture 144 is an aperture that is formed through the center of the closed face 142 of the shell 101 pan 111. The drive shaft 134 aperture 144 is geometrically similar to the drive shaft 134 of the drive motor 132 of the drive circuit 103. The drive shaft 134 aperture 144 is sized such that the drive shaft 134 inserts through the drive shaft 134 aperture 144. The drive shaft 134 gasket 145 is an elastomeric material. The drive shaft 134 gasket 145 lines the perimeter of the negative space that is formed by the drive shaft 134 aperture 144. The drive shaft 134 gasket 145 presses against the drive shaft 134 to form a fluid impermeable seal between the drive shaft 134 and the perimeter of the negative space that is formed by the drive shaft 134 aperture 144.

The lateral face 143 is the lateral face 143 of the pan structure of the shell 101 pan 111. The lateral face 143 forms the vertical containment of the hollow interior of the shell 101 pan 111. The lateral face 143 further comprises a plurality of vent apertures 146.

Each of the plurality of vent apertures 146 is an aperture that is formed through the lateral face 143 of the shell 101 pan 111. Each of the plurality of vent apertures 146 is positioned at a location proximal to the open face 141 of the shell 101 pan 111. Each of the plurality of vent apertures 146 allows for the free flow of gas into and out of the shell 101 pan 111 when the shell 101 pan 111 encloses the plurality of brushes 104.

The shell 101 pedestal 112 is a prism-shaped structure. The shell 101 pedestal 112 is a hollow structure. The shell 101 pedestal 112 has a disk shape. The shell 101 pan 111 mounts on the superior face of the disk shape of the shell 101 pedestal 112 to form the composite prism structure. The hollow interior of the shell 101 pedestal 112 contains the drive circuit 103. The shell 101 pedestal 112 is a rigid structure. The shell 101 pedestal 112 is formed with all apertures and form factors necessary to allow the shell 101 pedestal 112 to accommodate the use and operation of the drive circuit 103. Methods to form a shell 101 pedestal 112 suitable for the purposes described in this disclosure are well-known and documented in the mechanical arts.

The brush holder 102 is a prism-shaped structure. The brush holder 102 has a composite prism-shape. The brush holder 102 mounts within the shell 101. The brush holder 102 mechanically attaches to the drive circuit 103 such that the drive circuit 103 rotates the brush holder 102 within the shell 101. The brush holder 102 removably attaches to the drive circuit 103. The brush holder 102 stores the plurality of brushes 104 for storage. The brush holder 102 holds the plurality of brushes 104 submerged within the cleaning solution 171. The brush holder 102 rotates the plurality of brushes 104 within the cleaning solution 171 to clean the plurality of brushes 104. The brush holder 102 comprises a brush disk 121, a stanchion 122, and a drive disk 123. The stanchion 122 attaches the brush disk 121 to the drive disk 123 to form the composite prism structure of the brush holder 102. In the first potential embodiment of the disclosure, the brush disk 121, the stanchion 122, and the drive disk 123 are made of a ceramic.

The brush disk 121 is a prism-shaped structure. The brush disk 121 has a disk shape. The brush disk 121 is a foraminous structure. The brush disk 121 stores the plurality of brushes 104. The individual brush handle 162 of each of the plurality of brushes 104 inserts through the foraminous structure of the brush disk 121 for storage. The brush disk 121 further comprises a plurality of brush apertures 151 and a plurality of brush gaskets 152.

Each of the plurality of brush apertures 151 is a negative space that is formed through the faces of the disk structure of the brush disk 121. Each of the plurality of brush apertures 151 is sized to receive the individual brush handle 162 of a brush selected from the plurality of brushes 104. Each of the plurality of brush gaskets 152 is a gasket that lines the perimeter of a brush aperture selected from the plurality of brushes 104. Each of the plurality of brush gaskets 152 applies a friction to the individual brush handle 162 of the brush inserted into the associated brush aperture such that the brush is held in position within the associated brush aperture.

The stanchion 122 is a prism-shaped structure. The stanchion 122 is a rigid structure. The stanchion 122 attaches to the brush disk 121 to form a composite prism structure. The stanchion 122 attaches to the drive disk 123 to form a composite prism structure. The stanchion 122 elevates the brush disk 121 above the drive disk 123. The individual brush head 161 of each of the plurality of brushes 104 is positioned between the brush disk 121 and the drive disk 123 when the plurality of brushes 104 are immersed in the cleaning solution 171.

The drive disk 123 is a prism-shaped structure. The drive disk 123 has a disk shape. The drive disk 123 forms the inferior structure of the brush holder 102. The drive disk 123 removably attaches to the drive circuit 103 such that the drive circuit 103 will physically rotate the brush holder 102 during the cleaning of the plurality of brushes 104. The drive disk 123 further comprises a drive shaft 134 socket 153.

The drive shaft 134 socket 153 is a negative space that is formed in the face of the disk structure of the drive disk 123 that is distal from the stanchion 122. The drive shaft 134 socket 153 is secured to the drive shaft 134 of the drive motor 132 such that the rotation of the drive shaft 134 rotates the drive disk 123.

The drive circuit 103 is an electric circuit. The drive circuit 103 mounts in the shell 101. The drive circuit 103 mounts within the drive motor 132 of the shell 101. The drive circuit 103 removably attaches to the brush holder 102.

The drive circuit 103 generates the motive forces to rotate the plurality of brushes 104 within the cleaning solution 171. The drive circuit 103 transfers these rotational forces to the plurality of brushes 104 through the brush holder 102. The drive circuit 103 further comprises a master switch 131, a drive motor 132, and an external power source 133.

The master switch 131 is an electric switch. The master switch 131 is a maintained switch. The master switch 131 forms an electric connection between the external power source 133 and the drive motor 132. The master switch 131 controls the flow of electricity from the external power source 133 to the drive motor 132. The terms switch and maintained switch are defined elsewhere in this disclosure.

The drive motor 132 is an electric motor. The drive motor 132 receives electric energy drawn from the external power source 133 and converts the electric energy into mechanical rotational energy. The drive motor 132 further comprises a drive shaft 134

The drive shaft 134 is a prism-shaped structure. The drive shaft 134 is a rotating structure. The drive shaft 134 attaches to the drive motor 132 such that the center axis of the drive shaft 134 aligns with the axis of rotation of the drive motor 132. The drive shaft 134 mechanically attaches to the drive disk 123 of the brush holder 102 to form a composite prism structure. The drive shaft 134 attaches to the drive disk 123 such that the center axis of the drive disk 123 aligns with the axis of rotation of the drive motor 132. The drive shaft 134 transfers the rotational forces generated by the drive motor 132 to the drive disk 123 such that the rotation of the drive shaft 134 rotates the brush holder 102. The drive shaft 134 is geometrically similar to the drive shaft 134 socket 153 formed in the drive disk 123. The drive shaft 134 attaches to the drive disk 123 by inserting into the drive shaft 134 socket 153.

When the invention 100 is configured for cleaning, the drive shaft 134 inserts through the closed face 142 of the shell 101 pan 111 before inserting into the drive shaft 134 socket 153. In this scenario, the drive shaft 134 inserts through the drive shaft 134 aperture 144 and the drive shaft 134 gasket 145 of the closed face 142 of the shell 101 pan 111. The drive shaft 134 gasket 145 seals the space between the drive shaft 134 and the drive shaft 134 aperture 144 such that the cleaning solution 171 does not leak out of the shell 101 pan 111.

The external power source 133 is an externally provided source of electric energy. In the first potential embodiment of the disclosure, the external power source 133 is a battery. The external power source 133 and the battery are defined elsewhere in this disclosure.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Aperture: As used in this disclosure, an aperture is a prism-shaped negative space that is formed completely through a structure or the surface of a hollow structure.

At a Location Proximal to: As used in this disclosure, the term "at a location proximal to" identifies the position of an object selected from a group relative to an identified location such that the span of distance from the identified location and the selected object is less than the span of distance between the identified location and any object remaining in the group. Stated less formally, at a location proximal to means that the selected object is closer to the identified location than any other object selected from the group.

Battery: As used in this disclosure, a battery is a chemical device consisting of one or more cells, in which chemical energy is converted into electricity and used as a source of power. Batteries are commonly defined with a positive terminal and a negative terminal.

Bearing: As used in this disclosure, a bearing is a mechanical device that: 1) guides and limits the motion of a moving component relative to a fixed component; and, 2) reduces the friction between the moving component and the fixed component. A locking bearing is a bearing that can be locked such that the rotation of movements secured into a fixed position until the locking bearing is subsequently unlocked. The use of bearings is well known and documented in the mechanical arts.

Bristle: As used in this disclosure, a bristle is a short coarse stiff hair or hair like object.

Brush: As used in this disclosure, a brush is a tool comprising a plurality of bristles set into a handle or a base that is used for grooming, sweeping, smoothing, scrubbing, or painting.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Center of Rotation: As used in this disclosure, the center of rotation is the point of a rotating plane that does not move with the rotation of the plane. A line within a rotating three-dimensional object that does not move with the rotation of the object is also referred to as an axis of rotation.

Ceramic: As used in this disclosure, a ceramic is a rigid structure that: a) is formed from an inorganic material (often a mineral); that, b) does not contain a significant metal content. A ceramic is formed and then heated (referred to as fired) to a temperature between 800 C and 1500 C.

Cleaning Solution: As used in this disclosure, a cleaning solution is a chemical solution that contains a solvent used to dissolve a cleaning agent.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Elastic Nature: As used in this disclosure, an elastic nature refers to a flexible structure that returns to its relaxed shape after the flexible structure has been deformed.

Electric Motor: In this disclosure, an electric motor is a machine that converts electric energy into rotational mechanical energy. An electric motor typically comprises a stator and a rotor. The stator is a stationary hollow cylindrical structure that forms a magnetic field. The rotor is a magnetically active rotating cylindrical structure that is coaxially mounted in the stator. The magnetic interactions between the rotor and the stator physically causes the rotor to rotate within the stator thereby generating rotational mechanical energy. This disclosure assumes that the power source is an externally provided source of DC electrical power. The use of DC power is not critical and AC power can be used by exchanging the DC electric motor with an AC motor that has a reversible starter winding.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

External Power Source: As used in this disclosure, an external power source is a source of the energy that is externally provided to enable the operation of the present disclosure. Examples of external power sources include, but are not limited to, electrical power sources and compressed air sources.

Foraminous: As used in this disclosure, foraminous is an adjective that describes a surface, plate, or platform that is perforated with a plurality of apertures.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Gasket: As used in this disclosure, a gasket is an elastomeric material that is placed between a first surface and a second surface for the purpose of: 1) creating a liquid or gas impermeable seal between the first surface and the second surface; or, 2) preventing the first surface from damaging the second surface (or vice versa).

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inelastic Nature: As used in this disclosure, an inelastic nature refers to a flexible structure that maintains its new shape after the flexible structure has been deformed.

Inferior: As used in this disclosure, the term inferior refers to a directional reference that is parallel to and in the same direction as the force of gravity when an object is positioned or used normally.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Maintained Switch: A used in this disclosure, a maintained switch is a switch that maintains the position that was set in the most recent switch actuation. A maintained switch works in an opposite manner to a momentary switch.

Motor: As used in this disclosure, a motor refers to the method of transferring energy from an external power source into rotational mechanical energy.

Negative Space: As used in this disclosure, negative space is a method of defining an object through the use of open or empty space as the definition of the object itself, or, through the use of open or empty space to describe the boundaries of an object.

Non-Polar Molecule: As used in this disclosure, a non-polar molecule refers to a molecular structure that: a) is electrically neutral; and, b) has a uniform spatial distribution of the electrons within the molecule.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan is are open.

Pedestal: As used in this disclosure, a pedestal is an intermediary load bearing structure that forms a load path between a supporting surface and an object, structure, or load.

Perimeter: As used in this disclosure, a perimeter is one or more curved or straight lines that bounds an enclosed area on a plane or surface. The perimeter of a circle is commonly referred to as a circumference.

Polar Molecule: As used in this disclosure, a polar molecule refers to a molecular structure that: a) is electrically neutral; but, b) does not have a uniform spatial distribution of the electrons within the molecule. A polar molecule will present one or more electrically positive poles and the same number of electrically negative poles within the molecular structure.

Polarity: As used in this disclosure, the term polarity is used to describe a physical property or physical characteristic wherein: 1) the physical property or physical characteristic manifests two opposing attributes, tendencies, characteristics, or principals; and, 2) the two opposing attributes, tendencies, characteristics, or principals have an intrinsic separation, alignment, or orientation.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Relaxed Shape: As used in this disclosure, a structure is considered to be in its relaxed state when no shear, strain, or torsional forces are being applied to the structure.

Rigid Structure: As used in this disclosure, a rigid structure is a solid structure formed from an inelastic material that resists changes in shape. A rigid structure will permanently deform as it fails under a force. See bimodal flexible structure.

Rolling Element Bearing: As used in this disclosure, a rolling element bearing comprises is a type of bearing comprising an inner race, and outer race, and a plurality of ball bearings. The plurality of ball bearings are sphere shaped. The inner race is a circular ring. The outer race is a circular ring with an inner diameter that is greater than the outer diameter of the inner race. The plurality of ball bearings are placed between the inner race and the outer race such that: 1) the inner race and the outer race are coaxially positioned; and, 2) the inner race rotates relative to the outer race. Typically, the inner race attaches to a first object and the outer race attaches to a second object such that the first object rotates relative to the second object. Typically, a rolling element bearing is disk shaped. A rolling element bearing is said to be "locking" when the relative position of the inner race in be locked into a fixed position relative to the outer race. Rolling element bearings, including locking versions, are: 1) commercially available; and, 2) well-known and documented in the mechanical arts.

Rotation: As used in this disclosure, rotation refers to the cyclic movement of an object around a fixed point or fixed axis. The verb of rotation is to rotate.

Seal: As used in this disclosure, a seal is a structure that forms a fluid impermeable barrier between two objects.

Shell: As used in this disclosure, a shell is a structure that forms an outer covering intended to contain an object. Shells are often, but not necessarily, rigid or semi-rigid structures that are intended to protect the object contained within it.

Socket: As used in this disclosure, a socket is an opening or a cavity that acts as a receptacle for an inserted part.

Solution: As used in this disclosure, a solution is a uniform mixture of two or more compounds in a liquid phase. The major component selected from the two or more compounds that forms the solution is called the solvent. The components remaining in the two or more compounds are called the solute. A polar solvent is a solvent formed from polar molecules. A non-polar solvent is a solvent formed from non-polar molecules. The rule of thumb that "like dissolves like" states that: a) solutes formed from polar molecules will dissolve in polar solvents but will not dissolve in non-polar solvents; and, b) solutes formed from non-polar molecules will dissolve in non-polar solvents but will not dissolve in polar solvents. Use Polarity Polar Molecule and non-polar molecule Stanchion: As used in this disclosure, a stanchion refers to a vertically oriented prism-shaped pole, post, or support.

Such As: As used in this disclosure, the term "such as" is a conjunction that relates a first phrase to a subsequent phrase. The term "such as" is used to introduce representative examples of structures that meet the requirements of the first phrase. As a first example of the use of the term "such as," the phrase: "the first textile attaches to the second textile using a fastener such as a hook and loop fastener" is taken to mean that a hook and loop fastener is suitable to use as the fastener but is not meant to exclude the use of a zipper or a sewn seam. As a second example of the use of the term "such as," the phrase: "the chemical substance is a halogen such as chlorine or bromine" is taken to mean that either chlorine or bromine are suitable for use as the halogen but is not meant to exclude the use of fluorine or iodine.

Such That: As used in this disclosure, the term "such that" is a conjunction that relates a first phrase to a subsequent phrase. The term "such that" is used to place a further limitation or requirement to the first phrase. As a first example of the use of the term "such that," the phrase: "the door attaches to the wall such that the door rotates relative to the wall" requires that the attachment of the door allows for this rotation. As a second example of the use of the term "such that," the phrase: "the chemical substance is selected such that the chemical substance is soluble in water" requires that the selected chemical substance is soluble in water. As a third example of the use of the term "such that," the phrase: "the lamp circuit is constructed such that the lamp circuit illuminates when the lamp circuit detects darkness" requires that the lamp circuit: a) detect the darkness; and, b) generate the illumination when the darkness is detected.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Tool: As used in this disclosure, a tool is a device, an apparatus, or an instrument that is used to carry out an activity, operation, or procedure.

Working Element: As used in this disclosure, the working element of a tool is the physical element on the tool that performs the actual activity, operation, or procedure the tool is designed to perform. For example, the cutting edge of a blade is the working element of a knife.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 8 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A rotating brush stand comprising
comprises a shell, a brush holder, a drive circuit, and a plurality of brushes;
wherein the brush holder stores the plurality of brushes;
wherein the shell contains the brush holder, the drive circuit, and the plurality of brushes;
wherein the shell pan comprises an open face, a closed face, and a lateral face;
wherein the open face is distal from the shell pedestal when the rotating brush stand is configured for use in cleaning;
wherein the open face is proximal to the shell pedestal when the shell pan encloses the plurality of brushes.

2. The rotating brush stand according to claim 1
wherein the rotating brush stand immerses the plurality of brushes in a cleaning solution;
wherein the rotating brush stand is a rotating structure;
wherein the drive circuit rotates the plurality of brushes within the cleaning solution to clean the plurality of brushes.

3. The rotating brush stand according to claim 2
wherein each of the plurality of brushes is a tool;
wherein each individual brush selected from the plurality of brushes further comprises an individual brush head and an individual brush handle;
wherein the individual brush head is the working element of the tool formed by any brush selected from the plurality of brushes;
wherein the individual brush handle is the handle of the tool formed by any brush selected from the plurality of brushes.

4. The rotating brush stand according to claim 3
wherein the shell is a prism-shaped structure;
wherein the shell has a composite prism-shape;
wherein the shell forms a housing that contains the brush holder, the drive circuit, the plurality of brushes, and the cleaning solution;
wherein the shell is a rigid structure;
wherein the shell forms a fluid impermeable configuration that contains the cleaning solution.

5. The rotating brush stand according to claim 4
wherein the brush holder has a composite shape;
wherein the brush holder mounts within the shell;
wherein the brush holder mechanically attaches to the drive circuit such that the drive circuit rotates the brush holder within the shell;
wherein the brush holder removably attaches to the drive circuit;
wherein the brush holder stores the plurality of brushes for storage;
wherein the brush holder holds the plurality of brushes submerged within the cleaning solution;
wherein the brush holder rotates the plurality of brushes within the cleaning solution to clean the plurality of brushes.

6. The rotating brush stand according to claim 5
wherein the drive circuit is an electric circuit;
wherein the drive circuit mounts in the shell;
wherein the drive circuit mounts within the drive motor of the shell;
wherein the drive circuit removably attaches to the brush holder;
wherein the drive circuit generates the motive forces to rotate the plurality of brushes within the cleaning solution;
wherein the drive circuit transfers these rotational forces to the plurality of brushes through the brush holder.

7. The rotating brush stand according to claim 6
wherein the shell comprises a shell pan and a shell pedestal;
wherein the shell pan mounts on the shell pedestal to form a composite structure.

8. The rotating brush stand according to claim 7
wherein the brush holder comprises a brush disk, a stanchion, and a drive disk;

wherein the stanchion attaches the brush disk to the drive disk to form the composite structure of the brush holder.

9. The rotating brush stand according to claim 8 wherein the shell pan is a hollow structure;

wherein the shell pan has a pan shape;

wherein the shell pan forms a fluid impermeable structure.

10. The rotating brush stand according to claim 9 wherein the open face is the open face of the pan structure of the shell pan;

wherein the shell pan is an invertible structure;

wherein when the open face of the shell pan forms the superior structure of the shell pan, the shell pan contains the brush holder, the plurality of brushes, and the cleaning solution;

wherein when the open face of the shell pan forms the inferior structure of the shell pan, the shell pan encloses the brush holder and the plurality of brushes;

wherein the closed face is the closed face of the pan structure of the shell pan;

wherein the closed face is the face of the shell pan that is distal from the open face;

wherein the lateral face is the lateral face of the pan structure of the shell pan;

wherein the lateral face forms the vertical containment of the hollow interior of the shell pan.

11. The rotating brush stand according to claim 10 wherein the shell pedestal is a hollow structure;

wherein the shell pedestal has a disk shape;

wherein the shell pan mounts on the superior face of the disk shape of the shell pedestal to form the composite structure;

wherein the hollow interior of the shell pedestal contains the drive circuit;

wherein the shell pedestal is a rigid structure.

12. The rotating brush stand according to claim 11 wherein the brush disk has a disk shape;

wherein the brush disk is a foraminous structure;

wherein the brush disk stores the plurality of brushes;

wherein the individual brush handle of each of the plurality of brushes inserts through the foraminous structure of the brush disk for storage;

wherein the stanchion is a rigid structure;

wherein the stanchion attaches to the brush disk to form a composite structure;

wherein the stanchion attaches to the drive disk to form a composite structure;

wherein the stanchion elevates the brush disk above the drive disk;

wherein the drive disk has a disk shape;

wherein the drive disk forms the inferior structure of the brush holder;

wherein the drive disk removably attaches to the drive circuit such that the drive circuit will physically rotate the brush holder during the cleaning of the plurality of brushes;

wherein the drive disk further comprises a drive shaft socket;

wherein the drive shaft socket is a negative space that is formed in the face of the disk structure of the drive disk that is distal from the stanchion.

13. The rotating brush stand according to claim 12 wherein the closed face further comprises a drive shaft aperture and a drive shaft gasket;

wherein the drive shaft aperture is an aperture that is formed through the center of the closed face of the shell pan;

wherein the drive shaft aperture is geometrically similar to the drive shaft of the drive motor of the drive circuit;

wherein the drive shaft aperture is sized such that the drive shaft inserts through the drive shaft aperture;

wherein the drive shaft gasket is an elastomeric material;

wherein the drive shaft gasket lines the perimeter of the negative space that is formed by the drive shaft aperture;

wherein the drive shaft gasket presses against the drive shaft to form a fluid impermeable seal between the drive shaft and the perimeter of the negative space that is formed by the drive shaft aperture;

wherein the lateral face further comprises a plurality of vent apertures;

wherein each of the plurality of vent apertures is an aperture that is formed through the lateral face of the shell pan;

wherein each of the plurality of vent apertures allows for the free flow of gas into and out of the shell pan when the shell pan encloses the plurality of brushes.

14. The rotating brush stand according to claim 13 wherein the brush disk further comprises a plurality of brush apertures and a plurality of brush gaskets;

wherein each of the plurality of brush apertures is a negative space that is formed through the faces of the disk structure of the brush disk;

wherein each of the plurality of brush apertures is sized to receive the individual brush handle of a brush selected from the plurality of brushes;

wherein each of the plurality of brush gaskets is a gasket that lines the perimeter of a brush aperture selected from the plurality of brushes;

wherein each of the plurality of brush gaskets applies a friction to the individual brush handle of the brush inserted into the associated brush aperture such that the brush is held in position within the associated brush aperture.

15. The rotating brush stand according to claim 14 wherein the drive circuit further comprises a master switch, a drive motor, and an external power source;

wherein the master switch is an electric switch;

wherein the master switch is a maintained switch;

wherein the master switch forms an electric connection between the external power source and the drive motor;

wherein the master switch controls the flow of electricity from the external power source to the drive motor;

wherein the drive motor is an electric motor;

wherein the drive motor receives electric energy drawn from the external power source and converts the electric energy into mechanical rotational energy.

16. The rotating brush stand according to claim 15 wherein the drive motor further comprises a drive shaft;

wherein the drive shaft is a rotating structure;

wherein the drive shaft attaches to the drive motor such that the center axis of the drive shaft aligns with the axis of rotation of the drive motor;

wherein the drive shaft mechanically attaches to the drive disk of the brush holder to form a composite structure;

wherein the drive shaft attaches to the drive disk such that the center axis of the drive disk aligns with the axis of rotation of the drive motor;

wherein the drive shaft transfers the rotational forces generated by the drive motor to the drive disk such that the rotation of the drive shaft rotates the brush holder;

wherein the drive shaft is geometrically similar to the drive shaft socket formed in the drive disk;

wherein the drive shaft attaches to the drive disk by inserting into the drive shaft socket;

wherein the drive shaft socket is secured to the drive shaft of the drive motor such that the rotation of the drive shaft rotates the drive disk;

wherein when the rotating brush stand is configured for cleaning, the drive shaft inserts through the closed face of the shell pan before inserting into the drive shaft socket;

wherein the drive shaft inserts through the drive shaft aperture and the drive shaft gasket of the closed face of the shell pan;

wherein the drive shaft gasket seals the space between the drive shaft and the drive shaft.

* * * * *